US006079103A

United States Patent [19]

Melton et al.

[11] Patent Number: 6,079,103

[45] Date of Patent: Jun. 27, 2000

[54] ADJUSTABLE ATTACHMENT COMB

[75] Inventors: Scott Melton, Erie; Jon Thomas Feas, Rock Falls, both of Ill.

[73] Assignee: Wahl Clipper Corporation, Sterling, Ill.

[21] Appl. No.: 09/005,322

[22] Filed: Jan. 9, 1998

[51] Int. Cl.[7] ..... B26B 19/38

[52] U.S. Cl. ..... 30/43.92; 30/537; 30/79

[58] Field of Search ..... 30/201, 202, 133, 30/537, 79, 43.92

[56] References Cited

U.S. PATENT DOCUMENTS

| | | | |
|---|---|---|---|
| 1,745,997 | 2/1930 | Kocourek et al. | 30/201 |
| 1,928,000 | 9/1933 | Adelmo | 30/202 |
| 2,103,418 | 12/1937 | Hagebeucker | 30/202 |
| 2,517,999 | 8/1950 | Giorgi | 30/201 |
| 2,716,809 | 9/1955 | Malone | 30/30 |
| 2,726,447 | 12/1955 | Maloy | 30/202 |
| 2,916,820 | 12/1959 | Clark | 30/201 |
| 2,941,293 | 6/1960 | Mazzoni | 30/201 |
| 2,974,412 | 3/1961 | Clark | 30/201 |
| 3,041,726 | 7/1962 | Hitson | 30/201 |
| 3,149,418 | 9/1964 | Milbourne | 30/201 |
| 3,264,735 | 8/1966 | Du Charme | 30/202 |
| 3,267,572 | 8/1966 | Cordova | 30/201 |
| 3,287,805 | 11/1966 | Du Charme | 30/202 |
| 3,648,370 | 3/1972 | Cercone | 30/201 |
| 3,986,258 | 10/1976 | Liedtke | 30/30 |
| 4,622,745 | 11/1986 | Wahl | 30/201 |
| 5,699,616 | 12/1997 | Ogawa | 30/201 |

FOREIGN PATENT DOCUMENTS

| | | |
|---|---|---|
| 37 27 482 A1 | 3/1989 | Germany . |
| 37 35 340 A1 | 4/1989 | Germany . |
| 54-140656 | 1/1979 | Japan . |

OTHER PUBLICATIONS

Moser Company Brochure, "The Ideal Accessories for your Moser Hair Clipper".

Philips Österreich Company Brochure and Photographs, "Verstellbahre Distanzkämme für Haarlängen bis 40mm", taken from the internet homepage address of Philips/Austria at www.philips.at.

*Primary Examiner*—Rinaldi I. Rada
*Assistant Examiner*—Kim Ngoc Tran
*Attorney, Agent, or Firm*—Greer, Burns & Crain, Ltd.

[57] ABSTRACT

The present invention provides an adjustable attachment comb for use with a hair cutting device, where the adjustable attachment comb includes a stationary comb chassis that is configured and arranged to be removably attached to a hair cutting device and a movable comb body that is configured and arranged to be adjustably attached to the stationary comb chassis in one of a plurality of predetermined settings. The movable comb body and the stationary comb chassis cooperate to form a complete attachment comb unit. To supply the adjustment feature, a plurality of adjustment formations are located on the stationary comb chassis, and at least one cooperating adjustment formation is located on the movable comb body. The movable comb body can be releasably secured upon the stationary comb chassis in one of the predetermined settings by a mating interaction between one of the plurality of adjustment formations and the at least one cooperating adjustment formation. One of the predetermined settings may be selected whether the attachment comb unit is in an attached state or an unattached state with respect to a hair cutting device, and whereby the selected predetermined setting is maintained even after the state of the attachment comb unit is changed from an attached state to an unattached state and vice-versa.

20 Claims, 5 Drawing Sheets

FIG. 3
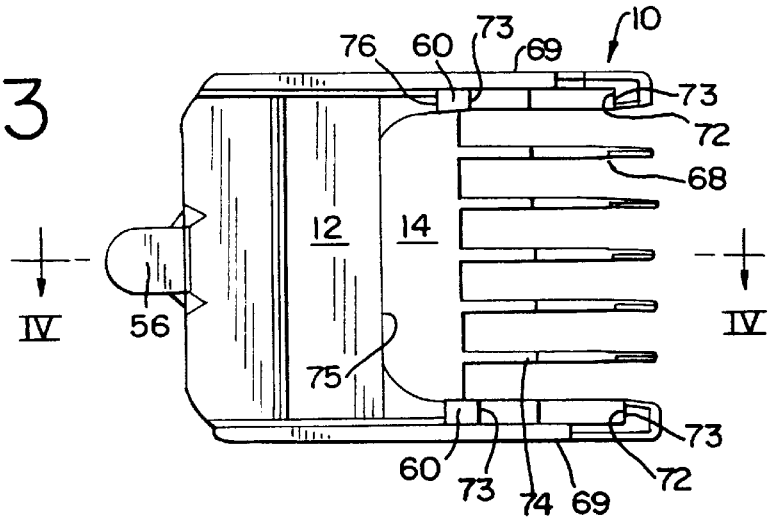
FIG. 4
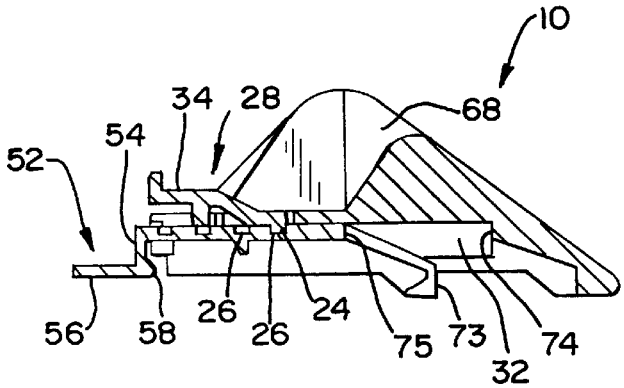
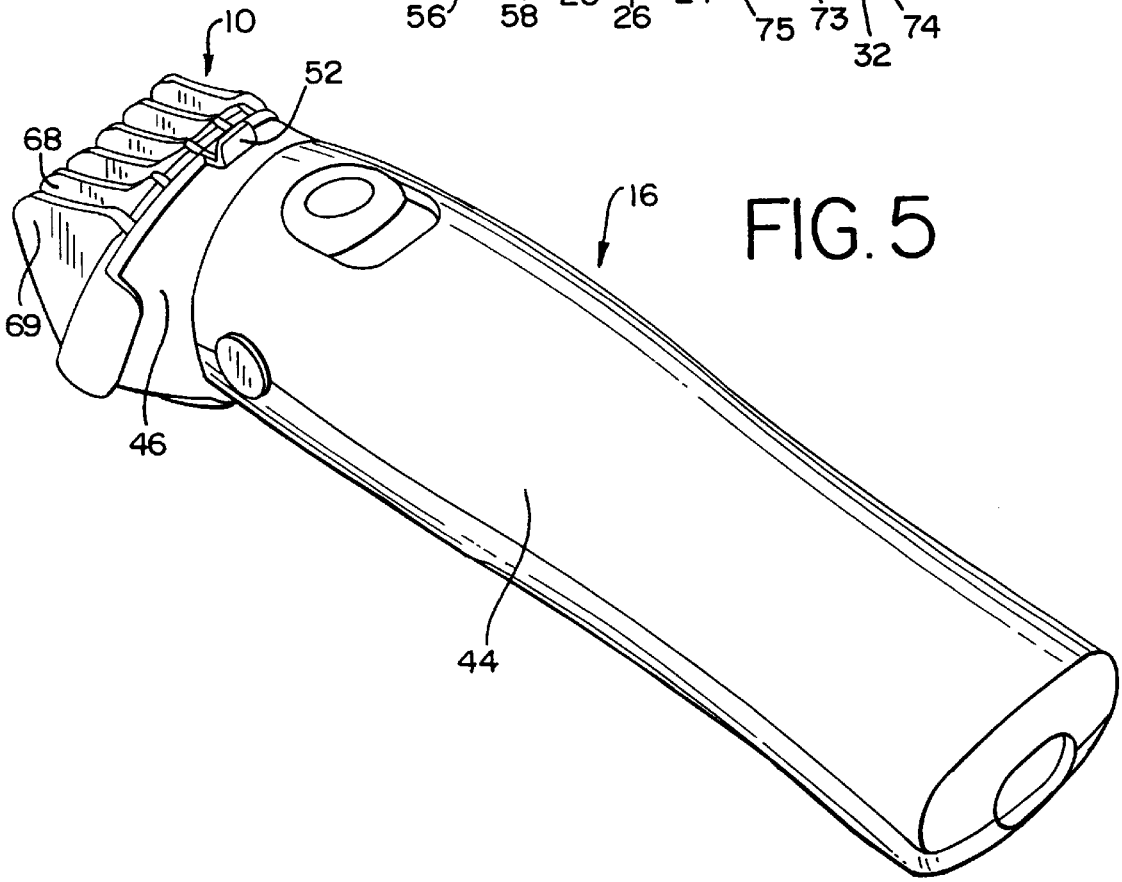
FIG. 5

ADJUSTABLE ATTACHMENT COMB

BACKGROUND

The present invention relates generally to an attachment comb for use with a hair cutting device, in which the attachment comb assists the user in cutting hair to a uniform length, and more particularly to a two-piece attachment comb that is adjustable between several different settings so that a single attachment comb can be used for cutting hair to any one of several different uniform lengths.

Presently, a few different types of attachment combs are available for use with hair cutting devices (such as hair clippers or hair trimmers). Generally, when an attachment comb is used, it is affixed to one end of the hair cutting device, near the cutting blades, and the attachment comb enables the user to trim the hair of the subject to a uniform length because the attachment comb maintains the cutting blades at a set distance from the surface of the area where the hair is being cut. Most attachment combs are designed to cut the hair to one, and only one, predetermined length. Attachment combs of this type will be referred to as single length attachment combs. When using a single length attachment comb, if one desires to cut the hair to a different length, a different single length attachment comb must be utilized. Thus, with single length attachment combs, a set of attachment combs of different sizes must be purchased and stored, and one attachment comb must be removed and another installed every time a different length cut is desired.

To avoid the need for the purchase and storage of multiple single length attachment combs of different sizes, adjustable attachment combs are also available. Adjustable attachment combs are capable of providing the user with a choice of different trimmed hair lengths from a single attachment comb. One example of such an adjustable attachment comb is disclosed in commonly assigned U.S. Pat. No. 4,622,745.

The adjustable attachment comb described in U.S. Pat. No. 4,622,745 is a single piece device in which the adjustment feature is realized by varying the position of where the attachment comb is secured to the hair cutting device. This type of adjustable attachment comb is capable of being affixed to the hair cutting device in several different locations along a plane defined by an extension of the cutting blades, which results in the distance between the cutting edges of the blades and the surface of the skin being different at each location. While such an adjustable attachment comb normally provides effective operation, on occasion the comb may become dislodged from its designated position if undue force is utilized, resulting in a change of the cutting length.

Additionally, with this type of adjustable attachment comb, the preselected cutting length is not maintained upon removal of the comb from the hair cutting device. Thus, upon re-installation of the attachment comb, a different securing position for the attachment comb may unintentionally be selected, resulting in the hair being cut to a length other than the uniform length originally selected.

Further, since this type of adjustable attachment comb relies upon a special configuration on both the attachment comb and on the hair cutting device for attaching the attachment comb to the hair cutting device, use of such an attachment comb is limited to hair cutting devices that are specially configured for receiving the adjustable attachment comb.

In addition to the single piece adjustable attachment comb just described, combs of a two piece design are also known. However, there are also problems associated with some models of the two piece design. Some models of the two piece design are not capable of maintaining their setting of a particular cut length after being removed from the hair cutting device. Thus, in a similar manner to that previously described in relation to the single piece adjustable comb, some two piece attachment combs may be re-installed upon the cutting device at a setting other than that originally intended, which results in the hair being cut to a length other than the uniform length previously selected.

An additional problem encountered with some two piece attachment combs relates to the comb's ability to be used to cut hair to relatively long lengths. In some previous designs, the strands of hair would not be adequately lifted by the fins, and therefore they were not properly positioned at the cutting blades. This problem could result in the hair being cut to uneven lengths.

In light of the problems discussed above, and other problems associated with presently available attachment combs, an object of the present invention is to provide an improved adjustable attachment comb for use in trimming hair to any one of a number of different uniform lengths.

Another object of the present invention is to provide an improved adjustable attachment comb in which the comb is securely maintained in the desired position upon the hair cutting device.

A third object of the present invention is to provide an improved adjustable attachment comb that can be maintained at a selected adjustment position even when the attachment comb is removed from the hair cutting device, so that it can also be re-installed upon the hair cutting device with the same selected adjustment position.

Yet another object of the present invention is to provide an improved adjustable attachment comb of a two-piece design that includes a movable comb body and a stationary comb chassis.

A related object of the present invention is to provide an improved adjustable attachment comb of a two-piece design that may be attached to a hair cutting device where the adjustability feature does not rely upon a special configuration of the attachment comb seating area on the hair cutting device in which adjustments are realized by positioning the comb upon the cutting device in different locations, but where the adjustability is instead realized by relative movement within the two-piece attachment comb unit. In this manner, hair cutting devices will be able to receive the present two-piece adjustable attachment comb, as well as being able to receive one-piece attachment combs that are not adjustable.

Still another object of the present invention is to provide an improved adjustable attachment comb of a two piece design suitable for cutting hair to relatively long lengths.

A related object is to provide an improved adjustable attachment comb of a two piece design in which both pieces include a set of fins thereon, and where the fins cooperate to adequately lift the strands of hair to enable the hair to be cut to relatively long lengths.

Yet another related object of the present invention is to provide an improved two piece attachment comb with a set of fins on each piece where the set of fins on one piece of the comb are capable of sliding within a set of channels on the other set of fins, whereby a variable length lifting surface is created.

These and other objects of the present invention are discussed or will be apparent from the following detailed description of the present invention.

SUMMARY OF THE INVENTION

The above-listed objects are met or exceeded by the present adjustable attachment comb. The adjustable attachment comb described hereinafter is an assembly of two components—a stationary comb chassis and a movable comb body. The stationary comb chassis is designed to be removably attached to a hair cutting device, and the movable comb body is designed to be attached to the stationary comb chassis and positioned at any one of a number of settings, where each different setting enables the hair cutting device and attachment comb combination to be used to trim hair to a different uniform length.

More particularly, the present invention provides an adjustable attachment comb for use with a hair cutting device, where the adjustable attachment comb includes a stationary comb chassis that is configured and arranged to be removably attached to a hair cutting device and a movable comb body that is configured and arranged to be adjustably attached to the stationary comb chassis in one of a plurality of predetermined settings. The movable comb body and the stationary comb chassis cooperate to form a complete attachment comb unit. To supply the adjustment feature, a plurality of adjustment formations are located on the stationary comb chassis, and at least one cooperating adjustment formation is located on the movable comb body. The movable comb body can be releasably secured upon the stationary comb chassis in one of the predetermined settings by a mating interaction between at least one of the plurality of adjustment formations and the at least one cooperating adjustment formation. One of the predetermined settings may be selected whether the attachment comb unit is in an attached state or an unattached state with respect to a hair cutting device, and whereby the selected predetermined setting is maintained even after the state of the attachment comb unit is changed from an attached state to an unattached state and vice-versa.

In an alternative embodiment, the present invention provides an attachment comb for use with a hair cutting device, where the attachment comb includes a stationary comb chassis configured and arranged to be removably attached to the hair cutting device and a movable comb body configured and arranged to be adjustably attached to the stationary comb chassis in one of a plurality of predetermined settings. In this embodiment, the stationary comb chassis and the movable comb body each include a set of fins extending therefrom. As in the first embodiment, the movable comb body and the stationary comb chassis cooperate to form a complete attachment comb unit. There is at least one adjustment formation located on the movable comb body, and a plurality of cooperating adjustment formations located on the stationary comb chassis, and wherein the movable comb body is releasably secured upon the stationary comb chassis in one of the predetermined settings by a mating interaction between at least one adjustment formation and at least one of the plurality of cooperating adjustment formations.

The alternative embodiment may also include a set of channels in one of the sets of fins, where the channels are designed to seat the fins from the other set of fins as the two pieces of the comb are slid relative to each other. With this design, the upper edges of the channels and the set of fins to be seated within the channels combine to create a variable length lifting surface that can support the strands of hair being cut. Because this variable length lifting surface can be relatively long, especially when the comb is set at the larger settings, the present invention can be used to cut hair to relatively long lengths. However, it should be also noted that this alternate embodiment may also be designed for use in cutting hair to shorter lengths.

BRIEF DESCRIPTION OF THE DRAWINGS

A preferred embodiment of the present invention is described herein with reference to the drawings wherein:

FIG. 3 is an assembled bottom view of the present adjustable attachment comb of the first embodiment;

FIG. 4 is a sectional view of the attachment comb unit of FIG. 3, taken along line IV—IV of FIG. 3 and in the direction generally indicated;

FIG. 5 is top perspective view of a hair cutting device with an embodiment of the present adjustable attachment comb attached thereto;

DESCRIPTION OF THE PREFERRED EMBODIMENTS

Figure 1:
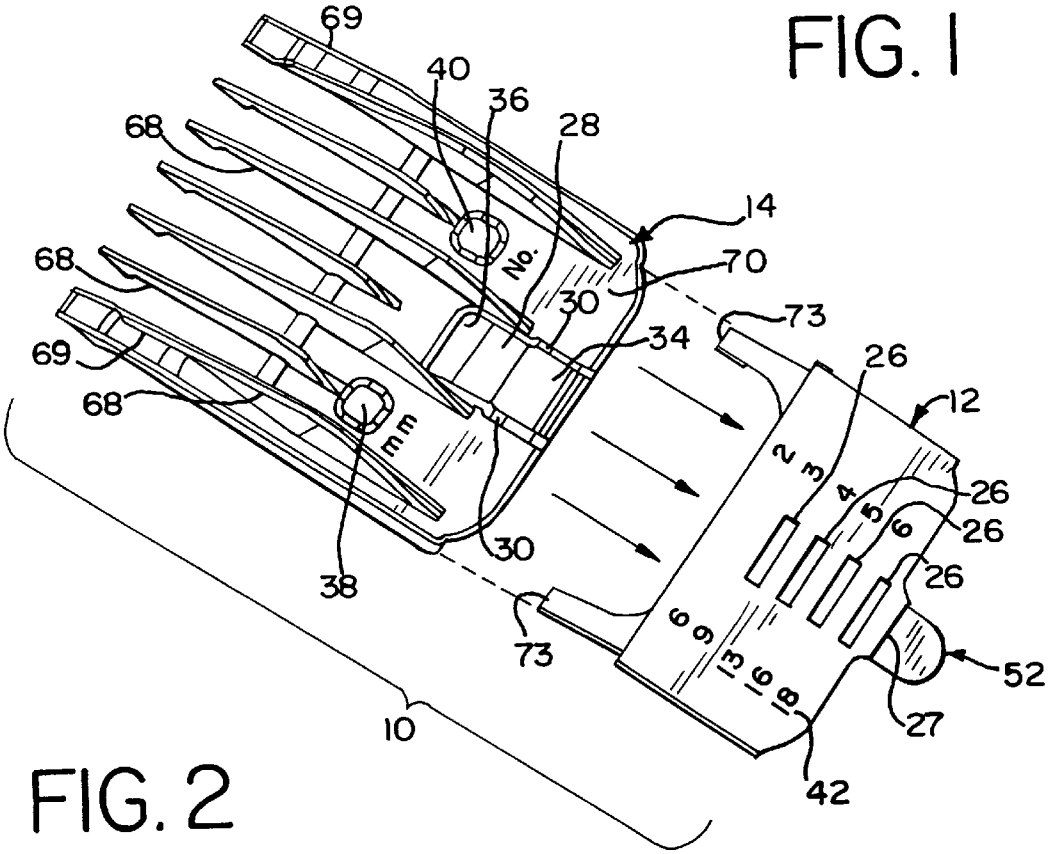
FIG. 1 is an exploded top perspective view of both pieces of a first embodiment of the present two-piece adjustable attachment comb.

Referring now to FIGS. 1–4, a first embodiment of the present two-piece adjustable attachment comb unit is generally designated 10, with a stationary comb chassis designated as 12 and a movable comb body designated as 14. Briefly, to form the complete attachment comb unit 10, the movable comb body 14 is moved in the direction of the arrows shown in FIGS. 1 and 2, and is attached to the stationary comb chassis 12 (in a manner described herein below). The complete attachment comb unit 10 can then be attached to a hair cutting device, such as the hair cutting device 16 shown in FIG. 5. As discussed below, the movable comb body 14 can be positioned in different positions with respect to the stationary comb chassis 12 to provide a tool to be used with a hair cutting device for cutting hair to any one of several different uniform lengths.

When reviewing the Specification, it should be understood that directional terms such as bottom, top, upwardly, downwardly, left, right, etc. have been used for convenience and clarity when referring to the drawing figures only, and are not intended to be read as limitations on the invention or on the operation of the invention. Throughout the Specification, the view shown in FIG. 1 has been referred to as a "top" view, and references to "up," "down," "upwardly," "downwardly," etc. are determined with respect to this "top" view because during installation and adjustment of the present attachment comb upon the hair cutting device, this will be the side that normally faces the user. However, it should be noted that in use during a hair trimming operation, the present attachment comb will normally be inverted from the view shown in FIG. 1.

Figure 2:
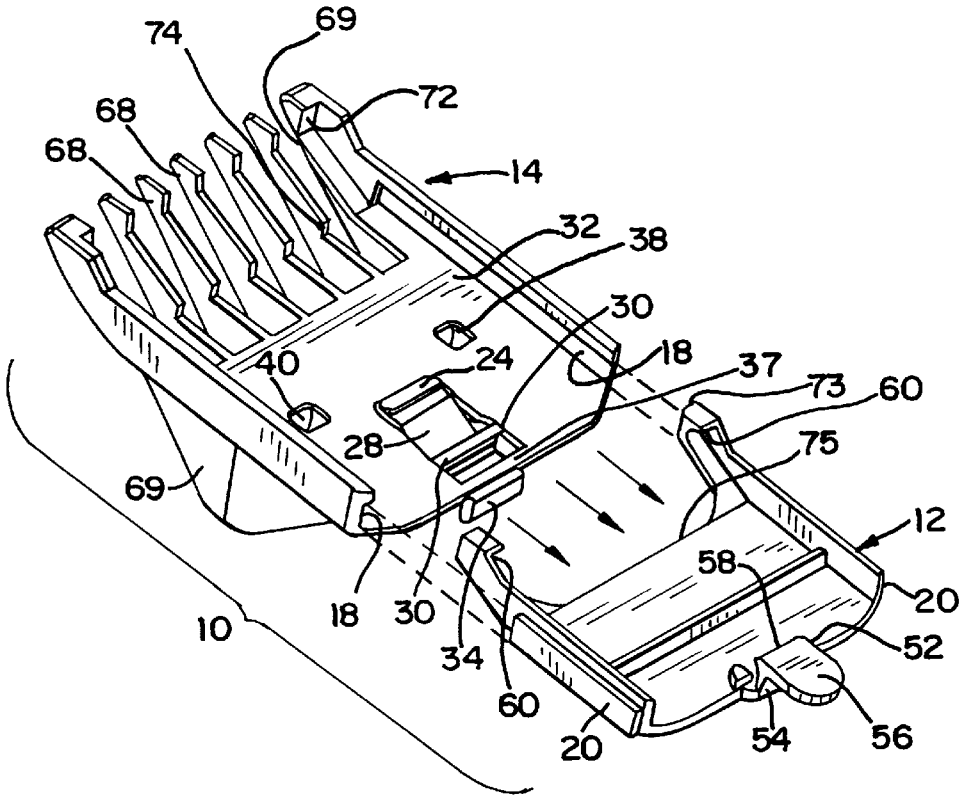
FIG. 2 is an exploded bottom perspective view of both pieces of the first embodiment of the present two-piece adjustable attachment comb.

As most clearly shown in FIG. 2, the movable comb body 14 includes a pair of guide rails 18 located on either side thereof. The guide rails 18 are configured to receive a pair of outer edges 20 located on the stationary comb chassis 12 when the user slides the movable comb body 14 in the direction of the arrows, which seats the movable comb body 14 upon the stationary comb chassis 12. Each outer edge 20 is essentially a rectangular block shaped projection that is configured to be inserted within a guide rail 18. While one configuration for obtaining the relative sliding motion between the stationary comb chassis 12 and the movable comb body 14 has been shown and described, it is contemplated that other methods of obtaining such relative sliding motion may also be used.

Once the movable comb body 14 and the stationary comb chassis 12 are combined to form the complete attachment comb unit 10, the resulting length of the hair to be cut can be selected from a number of different lengths by varying the position of the movable comb body 14 with respect to the stationary comb chassis 12. The movable comb body 14 can be secured at a different position, or setting, by engaging one type of adjustment formation, located on the movable comb body 14, with a cooperating adjustment formation of a type different than (but complementary to) the adjustment formation, and where several cooperating adjustment formations are located on the stationary comb chassis 12.

In the embodiment of FIGS. 1–4, the adjustment formation is represented by an elongated projection 24, and the cooperating adjustment formations are represented by elongated slots 26. However, other forms of adjustment formations and cooperating adjustment formations, as well as other locations for the adjustment formation and cooperating adjustment formations, are also contemplated as being within the scope of the invention. For example, a projection that is split into two smaller projections may be mated with an elongated slot; projections and slots of shapes other than those shapes shown may be utilized; dual projections and dual sets of slots may be provided; or several projections and a single slot may used.

In the preferred embodiment, the projection 24 extends downwardly from an adjustment locking tab 28, which is pivotally attached to the movable comb body 14 at two pivot points 30. In the embodiment shown, the pivot points 30 are not actually separate shafts about which the adjustable locking tab 28 rotates, but are instead integrally formed with the remainder of the movable comb body 14. Thus, the adjustable locking tab 28 forms a cantilever spring in which the projection 24 normally extends downwardly to a point below a substantially planar lower surface 32 of the movable comb body 14. Therefore, in its free state the projection 24 will mate with one of the slots 26, and will secure the movable comb body 14 at one of the settings. An additional setting (besides the settings designated by each of the slots 26) is also available by sliding the movable comb body 14 in the direction of the arrows to its limit in this direction. In this position, the projection 24 will cooperate with the rear peripheral edge 27 of the stationary chassis 12 (instead of one of the slots 26) to maintain the unit at this additional setting.

In order to change the setting (i.e., to change the resulting length of the cut hair), the adjustment locking tab 28 is pressed near its triggering end 34, which raises the projection 24, which is located on the opposite end, or the securing end 36, of the adjustment locking tab 28. By raising the projection 24, it is moved out of engagement with the particular slot 26 that it is currently engaged with, and the movable comb body 14 is free to slide with respect to the stationary comb chassis 12. Upon reaching the desired setting, the user stops pressing the triggering end 34 of the adjustment locking tab 28, and the projection 24 is biased downwardly until it becomes seated in another one of the slots 26 (or upon edge 27), which sets the adjustable attachment comb 10 to the new setting.

When the triggering end 34 is released, the adjustment locking tab 28 returns to its original position, with the projection 24 extending below the substantially planar lower surface 32, because of a memory feature designed into the adjustment locking tab 28. The memory feature is a result of a combination of the overall shape of the adjustment locking tab 28 and the plastic (or other suitable material) that the entire movable comb body 14 is fabricated from. Additionally, in order to prevent the user from over-pivoting the adjustment locking tab 28, a pivot stop 37 may be positioned below the triggering end 34. Although only one pivot design has been shown and discussed, it is contemplated that other means for pivoting the adjustment locking tab and for creating the memory feature may also be utilized without departing from the spirit of the invention.

To indicate to the user which of the settings has been selected, indicator windows 38 and 40 may be cut into the movable comb body 14. Indicator window 38 shows the length that the hair will be cut to. This length may be in millimeters (mm) as shown, or in inches, or in any other form of measurement. Another indicator window, indicator window 40, may be used to show a number (or other symbol), such as that from a system of numbering assigned to a set of single length attachment combs, in which the number (or symbol) designates which one of the single length attachment combs the present adjustable attachment comb is equivalent to at this particular setting. The numbers (or symbols) that show through the indicating windows 38 and 40 should be marked upon the substantially planar top surface 42 of the stationary comb chassis 12.

Figure 6:
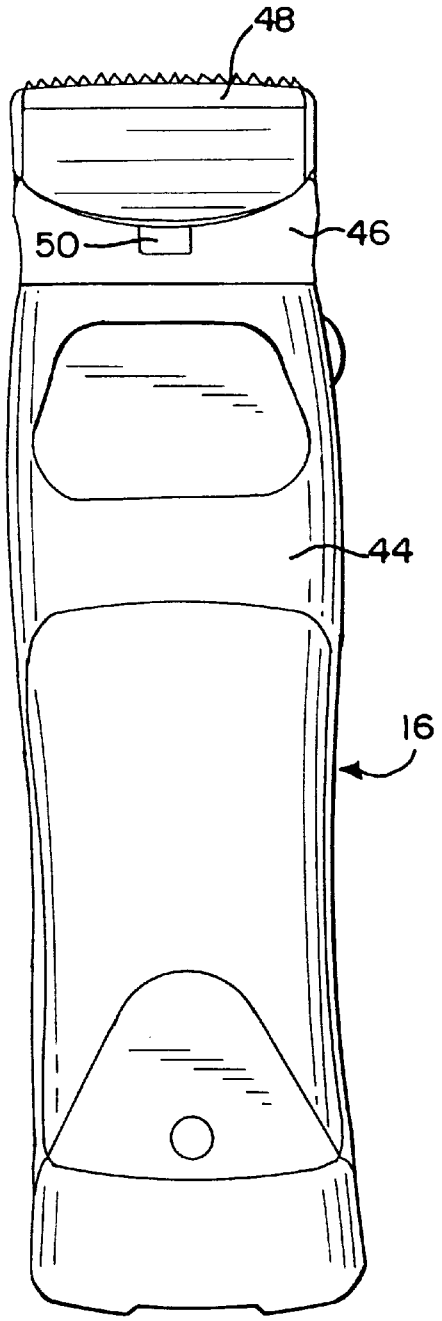
FIG. 6 is a bottom view of a hair cutting device that includes a depiction of a portion of an area suitable for the present attachment comb to be attached.
Figure 7:
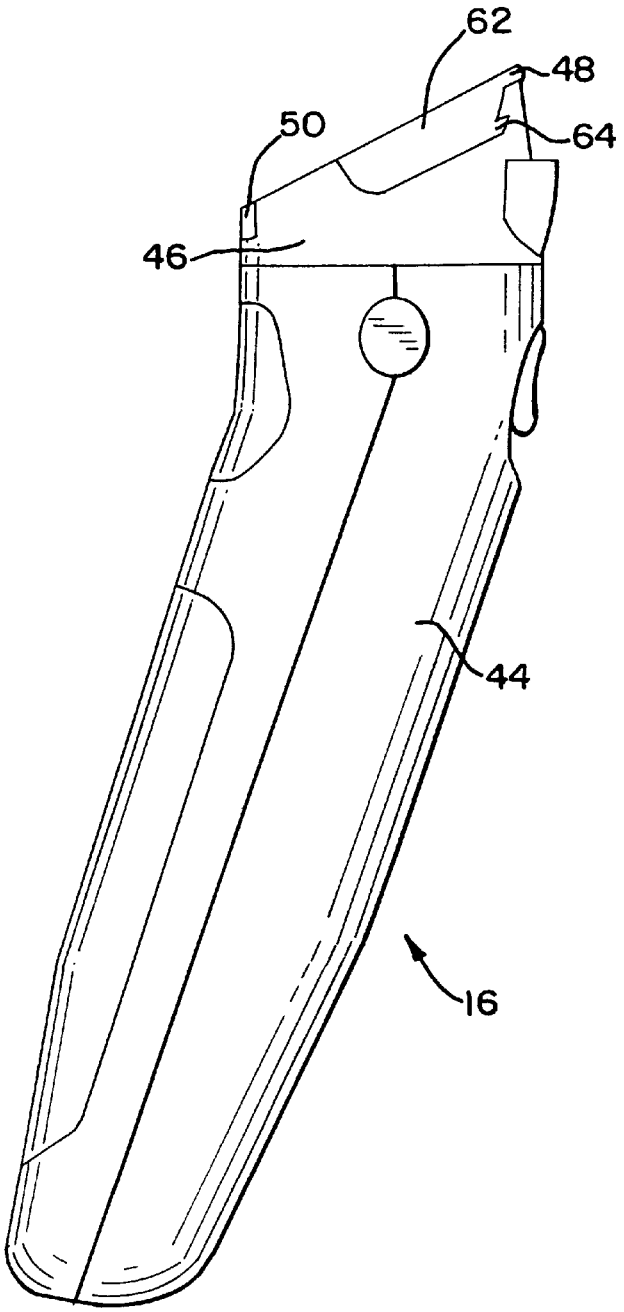
FIG. 7 is a side view of the hair cutting device of FIG. 6.
Figure 8:
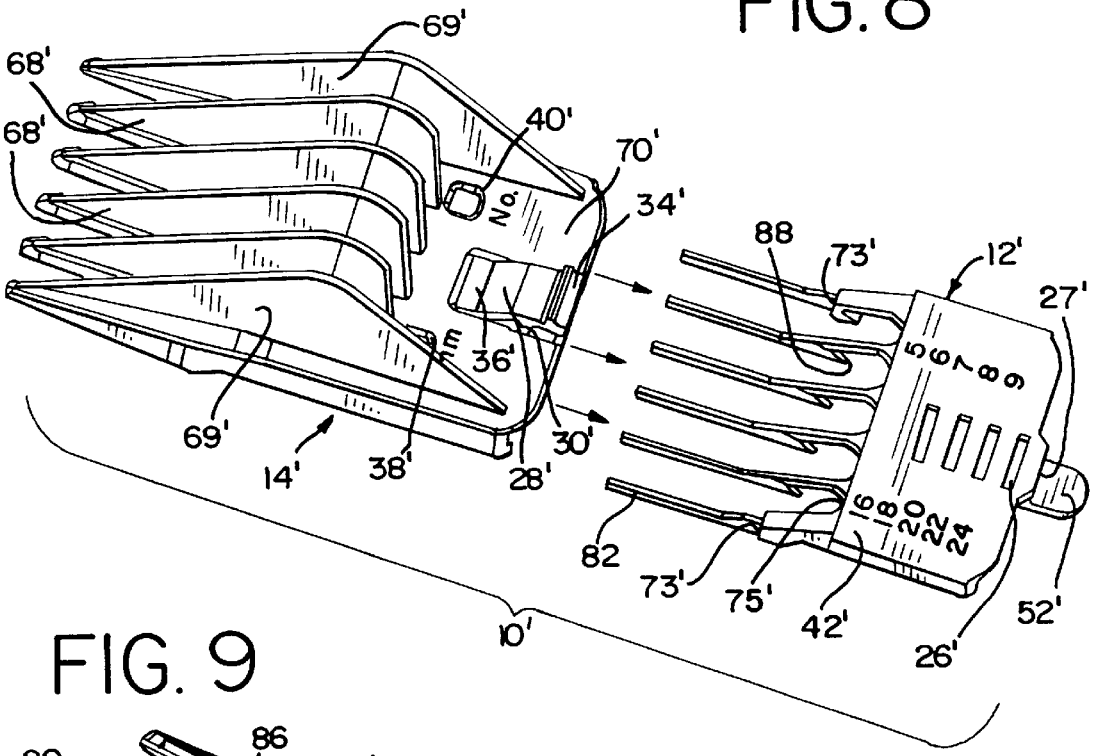
FIG. 8 is an exploded top perspective view of a second embodiment of the present two-piece adjustable attachment comb.

Referring primarily now to FIGS. 5–7, a description of the manner in which the present adjustable attachment comb 10 can be attached to the hair cutting device 16 will be provided. One example of a type of hair cutting device that the present adjustable attachment comb is adapted for use with is described in commonly assigned U.S. patent application Ser. No. 08/995,815, filed on Dec. 22, 1999, entitled "Hair Trimmer with Lighted Rotating Head," which was filed on the same date as the instant application, and is hereby incorporated by reference. However, other types of hair cutting devices are also suitable for use with the present adjustable attachment comb, as long as the adjustable attachment comb can be securely positioned onto the hair cutting device.

The hair cutting device 16 can be divided into two main sections—a main body 44 and a blade housing 46. Extending outside of the blade housing 46 are the tips of a pair of cutting blades at 48 (FIG. 2), which, as known to those of ordinary skill in the art, consists of a stationary blade and a laterally reciprocating blade that cooperate to cut the hair. Located on the blade housing 46, on the side opposite to the location of the tips of the cutting blades 48, is an indentation 50 (see FIG. 6). The indentation 50 is configured for receiving a portion of a latch 52 (see FIG. 5), which helps to attach the attachment comb 10 to the hair cutting device 16.

More detailed views of the latch 52 are shown in FIGS. 2 and 4. As shown, the latch 52 is generally L-shaped, and includes a vertical leg 54 and a horizontal leg 56. Extending outwardly from a side surface of the vertical leg 54 is a lip 58. The lip 58 is the portion of the latch 52 that mates with the indentation 50, and helps to keep the attachment comb 10 securely attached to the blade housing 46 of the hair cutting device 16.

Also contributing to maintaining the attachment comb 10 securely attached to the hair cutting device 16 is a pair of brackets 60 located near the front of the stationary comb chassis 12 (as shown in FIG. 2), and a matched pair of notches 62 (one of which is shown in FIG. 7), which are located on opposite sides of the blade housing 46. To secure the attachment comb unit 10 to the blade housing 46, the user slides the attachment comb unit 10 from front to back along the top surface of the blade housing 46 (right to left as shown in FIG. 7), with one bracket 60 in each notch 62, until the latch 52 is positioned near the indentation 50. Then, the lip 58 of the latch 52 can be snapped into the indentation 50, which signals that the attachment comb unit 10 is properly secured upon the blade housing 46. At this point, the brackets 60 are located in front seating portions 64 of the notches 62. As can be seen in FIG. 7, the shape of the front seating portion 64 hinders the bracket 60 from being unseated by an upwardly directed force.

To remove the attachment comb unit 10 from attachment with the blade housing 46, the user pushes up the latch 52 by pushing up the horizontal leg 56 with his thumb, or by otherwise adding an upward lifting force to the horizontal leg 56. Once the lip 58 of the latch 52 is unseated from the indentation 50, movement of the attachment comb unit 10 in the forward direction (towards the blades 48) is no longer inhibited, and the user may then forwardly slide the brackets 60 out of engagement with the notches 62. The front seating portions 64 do not inhibit the forward movement of the brackets 60 because the front of the blade housing 46 is curved, which permits the brackets 60 to freely slide out the front of the front seating portions 64. As a modification, the front seating portions 64 can also be extended to reach the front of the blade housing 46, which will also permit the brackets 64 to freely slide out of the front of the front seating brackets 64 (once the latch 52 has been disengaged from the indentation 50), whether the blade housing 46 is curved or not.

While one configuration of a seating area on a hair cutting device has been shown and described, it is contemplated that other types of seating areas may also be utilized. One example of such an alternative seating area (known to those skilled in the art) is the type where the attachment comb is seated directly upon the rear and side edges of the stationary blade. Other than some dimensional adjustments, the adjustable attachment comb 10 would not have to be modified from the form shown and described to be seated directly upon the stationary blade. Other configurations of complementary seating areas are also contemplated as being within the scope of the invention, as long as the primary features of adjustability are retained.

Referring again to FIGS. 1 and 2, to maintain the cutting surfaces of the blades 48 at a uniform distance from the scalp (or other surface where hair is being trimmed), numerous intermediate fins 68 and a pair of outer fins 69 extend upwardly from the substantially planar upper surface 70 of the movable comb body 14. In the present attachment comb 10, each different setting (in which the projection 24 is seated in either a different slot 26 or is abutting edge 27) spaces the cutting surfaces of the blades 48 at a different distance from the scalp. Thus, each setting results in the hair being cut to one uniform length, and upon changing the setting, the hair can be cut to a different uniform length. The fins 68 and 69 also help to align the hair and to guide it towards the cutting blades 48.

An additional feature of the present invention is a means for stopping the movable comb body 14 from being pushed too far in the rearward direction upon the stationary comb chassis 12 (i.e., the direction of the three arrows in FIGS. 1 and 2). To provide this stopping function, two shoulders 72 are formed on the front inner peripheries of the two outer fins 69. When the movable comb body 14 is pushed such that the shoulders 72 contact two front abutments 73 (on the stationary comb chassis 12), the shoulders 72 prevent further forward motion so that the movable comb body 14 does not unintentionally become unseated from the stationary comb chassis 12. To either supplement or replace the shoulders 72, auxiliary shoulders 74 (FIG. 2) may be formed on the underside of the intermediate fins 68. The auxiliary shoulders 74 function in a similar manner to the shoulders 72, except that the auxiliary shoulders 74 contact the front edge 75 on the stationary comb chassis 12, instead of contacting the front abutments 73, as is the case with the shoulders 72.

In operation, the present attachment comb unit 10 is attached to a hair cutting device 16 by: (1) seating the brackets 60 of the stationary comb chassis 12 within the front seating portions 64 on either side of the blade housing 46; and then (2) latching the lip 58 of the latch 52 within the indentation 50 on the rear side of the blade housing 46. A particular setting (i.e., a desired cut length) may be chosen by depressing the triggering end 34 of the adjustment locking tab 28, which permits the movable comb body 14 to slide relative to the stationary comb chassis 12. Once the desired setting is reached, the downward force upon the triggering end 34 is released, the projection 24 is biased into the desired one of the slots 26 (or to make contact with edge 27), and the movable comb body 14 is secured at the desired setting. The user may then begin clipping the hair to the desired uniform length that corresponds to the selected setting.

If the attachment comb 10 needs to be removed for any reason, this may be accomplished by simply pushing upwardly upon the horizontal leg 56 of the latch 52, and then disengaging the brackets 60 from the front seating portions 64 of the notches 62 on either side of the blade housing 46. An important feature of the comb 10 is that the selected setting is maintained even after the comb is detached from the hair cutting device 16. This is true, in part, because the biasing force between the projection 24 and one of the slots 26 (or the edge 27) is completely supplied by the two pieces of the attachment comb 10, and does not rely upon any tension created by the connection of the attachment comb 10 with the hair cutting device 16. The hair cutting device 16 may then be used without the attachment comb 10, or the attachment comb may be re-attached to the hair cutting device 16 with the same setting. Alternatively, the setting of the attachment comb 10 may be changed before the attachment comb 10 is re-attached to the hair cutting device 16. Changing the setting in the un-attached state is accomplished in the same manner as in the attached state.

FIGS. 8–11 depict a second embodiment of the present adjustable attachment comb 10'. Attachment comb 10' includes many of the same features as the first embodiment depicted as attachment comb 10 in FIGS. 1–4, which will be designated with the same index numbers with the addition of the prime symbol ('). The primary difference between the first and second embodiments 10, 10' is that the second embodiment includes a set of elongated fins 68' and 69'. Each elongated fin 68' or 69' includes a relatively long extension portion 78 that extends to its front termination point 80. These extension portions 78 permit the hair to be cut to longer lengths.

In addition, another important difference between the first embodiment and the second embodiment is that the second embodiment includes a set of auxiliary fins 82. The auxiliary fins 82 serve to adequately lift and support the strands of hair upon lifting surfaces 84 (preferably located on each auxiliary fin 84) that facilitate hair alignment so that it can be guided towards the cutting blades 48 of the hair cutting device 16. The auxiliary fins 82 and the associated lifting surfaces 84 are especially important when the comb is set at the settings configured for cutting hair to longer lengths. Thus, for example, even when the adjustment tab 52' is set to contact the edge 27' (i.e., at the longest setting), the strands of hair are adequately supported by a combination of the primary fins 68'/69' and the lifting surfaces 84 of the auxiliary fins 82. The use of such auxiliary fins enables the hair to be cut uniformly to lengths longer than those available with the first embodiment, shown in FIGS. 1–4.

Figure 9:
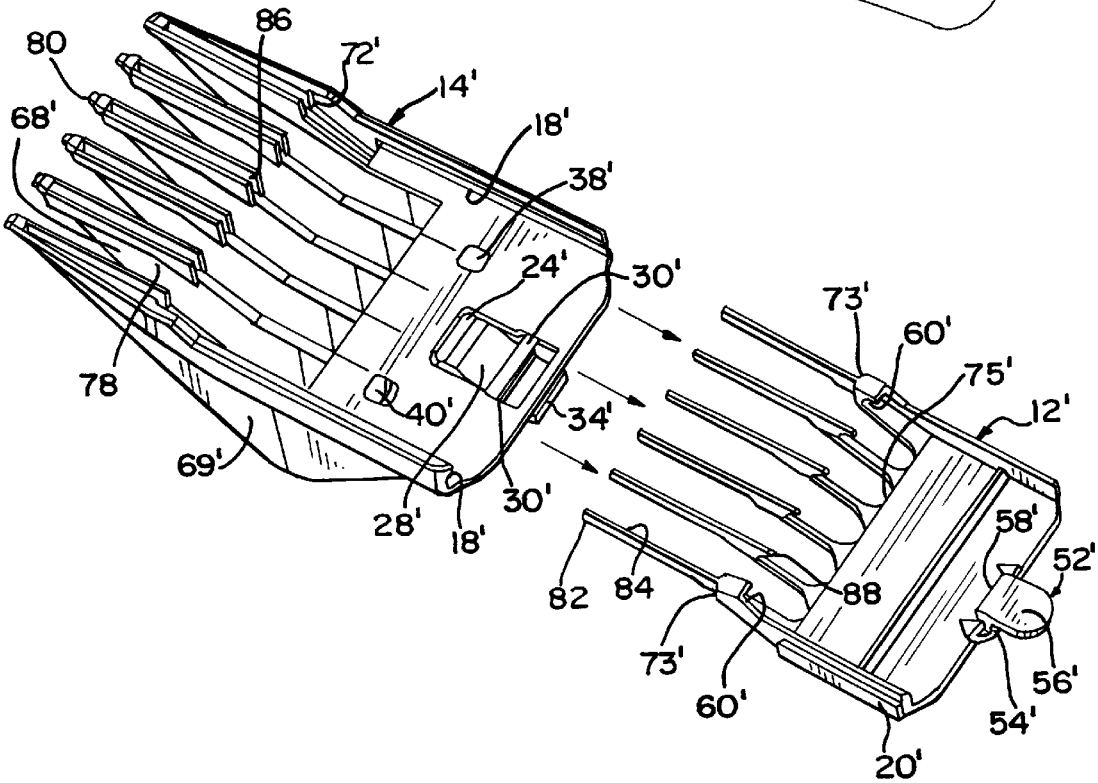
FIG. 9 is an exploded bottom perspective view of both pieces of the second embodiment of the present adjustable attachment comb.
Figure 10:
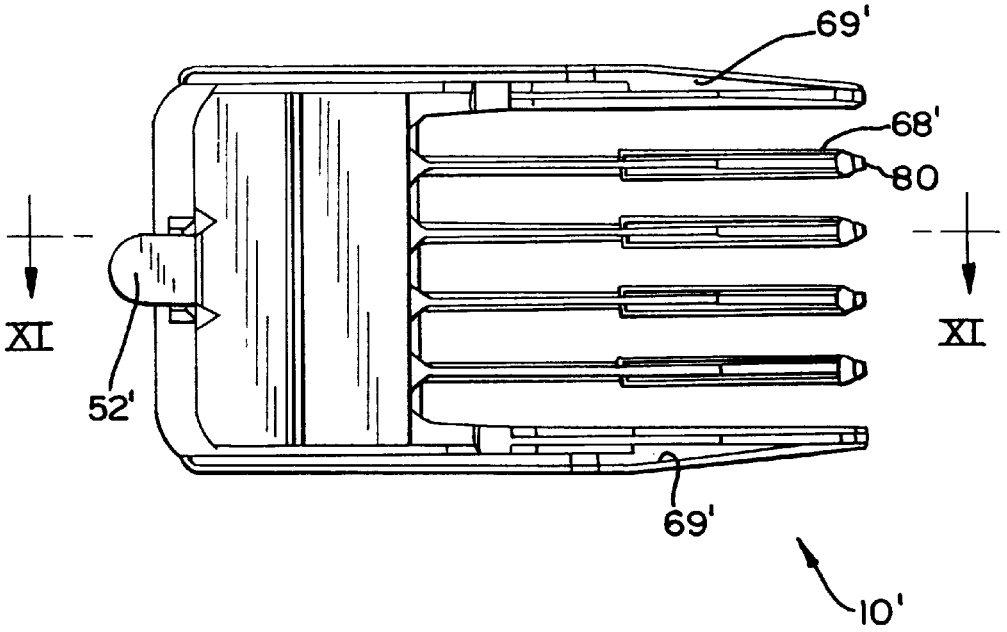
FIG. 10 is an assembled bottom view of the present adjustable attachment comb of the second embodiment.
Figure 11:
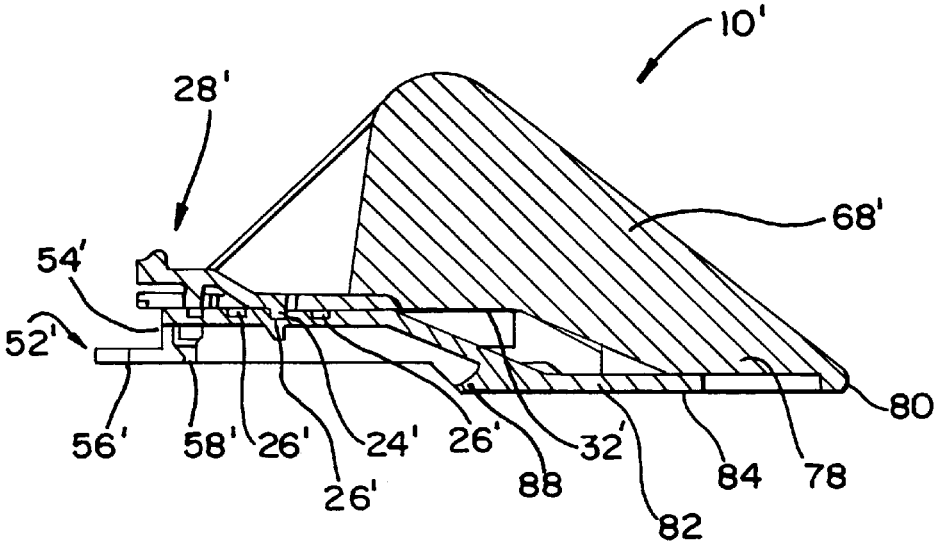
FIG. 11 is a sectional view of the attachment comb unit of FIG. 10, taken along line XI—XI of FIG. 11 and in the direction generally indicated.

To better guide the auxiliary fins 82 as they are slid along the underside of the primary fins 68'/69', the primary fins may each include a channel 86 (FIG. 9). Each channel 86 seats one of the auxiliary fins 82 as the movable comb body 14' is slidingly moved with respect to the stationary comb chassis 12'. In addition to this guiding function, the channels 86 also serve as extensions of the lifting surfaces 84 when the comb 10' is set for cutting hair to longer lengths. To further lengthen the lifting surfaces 84, the rear tips 88 of the auxiliary fins 82 may also be elongated, as best shown in FIG. 11. Besides the differences just discussed, the second embodiment of the adjustable attachment comb operates in substantially the same manner as the first embodiment.

While various embodiments of the present invention have been shown and described, it should be understood that other modifications, substitutions and alternatives will be apparent to one of ordinary skill in the art. Such modifications, substitutions and alternatives can be made without departing from the spirit and scope of the invention, which should be determined from the appended claims. Various features of the invention are set forth in the appended claims.

What is claimed is:

1. An attachment comb for use with a hair cutting device, said attachment comb comprising:

a stationary comb chassis configured and arranged to be removably attached to a hair cutting device, said stationary comb chassis being defined by a pair of side edges, a front edge and a rear edge, and including a substantially planar top surface;

a movable comb body configured and arranged to be adjustably attached to said stationary comb chassis in one of a plurality of predetermined settings to form an attachment comb unit, said movable comb body including a pair of rails configured and arranged to slidably connect with said side edges of said stationary comb chassis, a substantially planar lower surface adapted to oppose said substantially planar top surface of said stationary comb chassis, and a plurality of fins extending from an upper surface of said movable comb body in a direction substantially perpendicular to said substantially planar lower surface of said movable comb body; and at least one adjustment formation located on said movable comb body and a plurality of cooperating adjustment formations located on said substantially planar top surface of said stationary comb chassis, wherein said movable comb body is secured upon said stationary comb chassis in one of said predetermined settings by a mating interaction between said at least one adjustment formation and one of said plurality of said cooperating adjustment formations, and further wherein once one of said predetermined settings is selected, said selected predetermined setting is maintained when said attachment comb unit is transferred between an attached state, in which said attachment comb unit is attached to a hair cutting device, and a free state, in which said attachment comb unit is not attached to a hair cutting device;

wherein said plurality of cooperating adjustment formations are defined by a plurality of slots that are spaced apart from each other, and further wherein said at least one adjustment formation is defined by at least one projection that extends downwardly from an adjustment locking tab located on said movable comb body; and further wherein said adjustment locking tab is pivotally attached to said movable comb body and is defined by a securing end, which includes said projection, and a triggering end, which includes a section that can be pressed to disengage said projection from one of said slots in order to adjust the position of said movable comb body with respect to said stationary comb chassis and therefore change from one of said predetermined settings to another one of said predetermined settings.

2. The attachment comb defined in claim 1 wherein one of the predetermined settings is defined as the position when said projection is contacting an edge of said stationary comb chassis, without being seated within one of said plurality of slots.

3. The attachment comb as defined in claim 1 wherein said movable comb body includes a pair of guide rails extending along opposite ends thereof and said stationary comb chassis includes a pair of edges extending along opposite sides thereof, and wherein said pair of edges are configured and arranged to slidingly engage said pair of guide rails.

4. The attachment comb as defined in claim 1 wherein said stationary comb chassis includes a latch for attaching said attachment comb unit to a hair cutting device, wherein said latch is substantially L-shaped and is defined by a vertical leg and a horizontal leg, and further wherein said vertical leg includes a lip thereon configured and arranged to engage with an indentation on a hair cutting device.

5. The attachment comb as defined in claim 1 wherein said fins and a portion of said stationary comb chassis cooperate to define a stopping means for stopping movement of said movable body with respect to said stationary comb chassis.

6. An attachment comb for use with a hair cutting device having at least one stationary blade and at least one moving blade which together define a set of cutting blades, said attachment comb comprising:

a stationary comb chassis configured and arranged to be removably attached to the hair cutting device at a location adjacent the set of cutting blades;

a plurality of fins extending from said stationary comb chassis;

a movable comb body configured and arranged to be adjustably attached to said stationary comb chassis in one of a plurality of predetermined settings, said movable comb body and said stationary comb chassis cooperating to form a complete attachment comb unit; and at least one adjustment formation located on said movable comb body, and a plurality of cooperating adjustment formations located on said stationary comb chassis, wherein said movable comb body is releasably secured upon said stationary comb chassis in one of said predetermined settings by a mating interaction between said at least one adjustment formation and at least one of said plurality of cooperating adjustment formation.

7. The attachment comb as defined in claim 6 wherein said stationary comb chassis includes a front edge and a rear edge and wherein said fins extend away from said front edge of said stationary comb chassis.

8. The attachment comb as defined in claim 6 wherein said movable comb body also includes a set of fins defined as primary fins, and wherein said fins on said stationary comb chassis are defined as auxiliary fins.

9. The attachment comb as defined in claim 8 wherein said set of primary fins includes a set of channels configured and arranged for seating said set of auxiliary fins for sliding movement therebetween.

10. The attachment comb as defined in claim 9 wherein said channels and said auxiliary fins include upper surfaces thereon, and wherein said upper surfaces of said channels and said upper surfaces of said auxiliary fins are substantially aligned.

11. The attachment comb as defined in claim 8 wherein a majority of said primary fins each include a channel configured and arranged for seating one of said auxiliary fins for sliding movement therebetween.

12. The attachment comb as defined in claim 6 wherein:

said at least one adjustment formation is defined by at least one projection extending downwardly from said movable comb body;

said plurality of cooperating adjustment formations are defined by a plurality of substantially parallel indented slots spaced apart from each other; and an adjustment locking tab is pivotally attached to said movable comb and defined by a securing end, which includes said projection, and a triggering end, which includes a section that can be pressed to disengage said projection from one of said slots in order to adjust the position of said movable comb body with respect to said stationary comb chassis.

13. The attachment comb as defined in claim 6 wherein said movable comb body includes a pair of guide rails extending along opposite ends thereof and said stationary comb chassis includes a pair of edges extending along opposite sides thereof, and wherein said pair of edges are configured and arranged to slidingly engage said pair of guide rails.

14. An apparatus for trimming hair to one of a plurality of predetermined uniform lengths, said apparatus comprising:

a hair cutting device having a main body, a blade housing positioned on one end of said main body, and at least one stationary blade and at least one moving blade which together define a set of cutting blades, wherein said cutting blades are removably positioned on said blade housing;

an adjustable attachment comb configured and arranged to be removably attached to said blade housing of said hair cutting device, said adjustable attachment comb for maintaining said set of cutting blades at a selected predetermined distance from the skin of a subject, wherein said selected predetermined distance is selected from a plurality of predetermined distances available on said adjustable attachment comb, and further wherein said adjustable attachment comb includes:

a stationary comb chassis configured and arranged to be removably attached to the hair cutting device at a location adjacent said set of cutting blades;

a plurality of fins extending from said stationary comb chassis;

a movable comb body configured and arranged to be adjustably attached to said stationary comb chassis in one of a plurality of predetermined settings, said movable comb body and said stationary comb chassis cooperating to form a complete attachment comb unit; and at least one adjustment formation located on said movable comb body, and a plurality of cooperating adjustment formations located on said stationary comb chassis, wherein said movable comb body is releasably secured upon said stationary comb chassis in one of said predetermined settings by a mating interaction between said at least one adjustment formation and at least one of said plurality of cooperating adjustment formations.

15. The apparatus as defined in claim 14 wherein said movable comb body also includes a set of fins defined as primary fins, and wherein said fins on said stationary comb chassis are defined as auxiliary fins, said set of primary fins including a set of channels configured and arranged for seating said set of auxiliary fins for sliding movement therebetween, and further wherein said channels and said auxiliary fins include upper surfaces thereon, said upper surfaces of said channels and said upper surfaces of said auxiliary fins being substantially aligned.

16. The apparatus as defined in claim 14, wherein:

said blade housing of said hair cutting device includes a pair of notches located on sides thereof surrounding a cutting surface of said cutting means and further includes an indented portion located on a side opposite from said cutting surface; and said stationary comb chassis includes a pair of brackets configured and arranged to interact with said pair of notches, and a latch configured and arranged to interact with said indented portion, wherein said adjustable attachment comb is removably attached to said hair cutting device by cooperation between said pair of brackets and said pair of notches and between said latch and said indented portion.

17. The apparatus as defined in claim 14 wherein said plurality of cooperating adjustment formations are defined by a plurality of slots that are spaced apart from each other, and further wherein said at least one adjustment formation is defined by at least one projection.

18. The apparatus as defined in claim 14 wherein said cutting means includes a stationary blade and a reciprocating blade, and further wherein said adjustable attachment comb is attached to said blade housing without reliance upon contact with said stationary blade.

19. The apparatus as defined in claim 14 wherein said plurality of cooperating adjustment formations are defined by a plurality of slots that are spaced apart from each other, and further wherein said at least one adjustment formation is defined by at least one projection that extends from an adjustment locking tab located on said movable comb body, and further wherein said adjustment locking tab is pivotally attached to said movable comb body.

20. An apparatus for trimming hair to one of a plurality of predetermined uniform lengths, said apparatus comprising:

a hair cutting device having a main body, a blade housing positioned on one end of said main body, and a cutting means removably positioned on said blade housing;

an adjustable attachment comb configured and arranged to be removably attached to said blade housing of said hair cutting device, said adjustable attachment comb for maintaining said cutting means at a selected predetermined distance from the skin of a subject, wherein said selected predetermined distance is selected from a plurality of predetermined distances available on said adjustable attachment comb, and further wherein said adjustable attachment comb includes:

a stationary comb chassis configured and arranged to be removably attached to the hair cutting device;

a plurality of fins extending from said stationary comb chassis;

a movable comb body configured and arranged to be adjustably attached to said stationary comb chassis in one of a plurality of predetermined settings, said movable comb body and said stationary comb chassis cooperating to form a complete attachment comb unit; and at least one adjustment formation located on said movable comb body, and a plurality of cooperating adjustment formations located on said stationary comb chassis, wherein said movable comb body is releasably secured upon said stationary comb chassis in one of said predetermined settings by a mating interaction between said at least one adjustment formation and at least one of said plurality of cooperating adjustment formation;

wherein said stationary comb chassis includes a latch for attaching said attachment comb unit to a hair cutting device, wherein said latch is substantially L-shaped and is defined by a vertical leg and a horizontal leg, and further wherein said vertical leg includes a lip thereon configured and arranged to engage with an indentation on said hair cutting device.

* * * * *

UNITED STATES PATENT AND TRADEMARK OFFICE

CERTIFICATE OF CORRECTION

PATENT NO. : 6,079,103
DATED : June 27, 2000
INVENTOR(S) : Melton et al.

It is certified that error appears in the above-identified patent and that said Letters Patent is hereby corrected as shown below:

Title page,
Item [75], Inventor: Replace "Jon Thomas Feas" with -- Jon Thomas Freas --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*